US005715957A

United States Patent [19]

Merl

[11] Patent Number: 5,715,957

[45] Date of Patent: Feb. 10, 1998

[54] SHELF SYSTEM

[76] Inventor: Milton J. Merl, 50 Wilcox Rd., Stonington, Conn. 06830

[21] Appl. No.: 578,104

[22] Filed: Dec. 26, 1995

[51] Int. Cl.[6] ..... A47F 5/00

[52] U.S. Cl. ..... 211/187

[58] Field of Search ..... 211/187, 90, 103, 211/193; 108/92, 102, 108, 137, 143, 179

[56] References Cited

U.S. PATENT DOCUMENTS

| | | | |
|---|---|---|---|
| 3,993,002 | 11/1976 | Stroh | 108/108 |
| 4,583,648 | 4/1986 | Buffington et al. | 211/90 |
| 4,589,349 | 5/1986 | Gebhardt et al. | 108/137 X |
| 4,646,658 | 3/1987 | Lee | 108/143 |
| 4,776,472 | 10/1988 | Rosen | 108/137 X |
| 5,170,897 | 12/1992 | Wentworth | 108/102 X |
| 5,531,159 | 7/1996 | Stubblefield | 108/102 |

*Primary Examiner*—Alvin C. Chin-Shue
*Assistant Examiner*—Sarah L. Purol
*Attorney, Agent, or Firm*—Schweitzer Cornman Gross and Bondell LLP

[57] ABSTRACT

A shelving system is designed for use in conjunction with a store gondola unit having a pair of uprights for conventional shelves. The system has a pair of auxiliary uprights which are mounted to a crossbar which in turn can be affixed to the gondola uprights. The auxiliary uprights are of a right-angle construction, each of the legs of the construction being provided with closely spaced apertures. Horizontal shelf supports are mounted to the auxiliary uprights, engagement occurring in two perpendicular planes to rigidly lock the shelf supports in position. A shelf is slidably mounted to the horizontal supports, and may include front and rear portions, the rear portion being pivotable between a horizontal and an elevated position. The front portion may include a well at the front thereof to further maintain product at the front of the shelf. The rear shelf portion, when pivoted upwardly, allows inventory stocked on a next-lower shelf to extend upward into the space otherwise occupied by the rear shelf portion when in the horizontal position, thereby providing for additional inventory storage space.

20 Claims, 8 Drawing Sheets

SHELF SYSTEM

The present invention relates to a merchandising system and more particularly to an improved, integrated shelving system for use in conjunction with currently available store shelf mounts and gondolas.

BACKGROUND OF THE INVENTION

The majority of inventory and retail stores is carried in a form of shelving construction utilizing gondolas or trays for the products. Such format has changed little over the years. A floor platform supports a vertical upright backing board which defines the gondola. The gondola includes vertical weight-supporting uprights having a plurality of vertical slots. The slots and uprights are adapted to support shelving and other elements in or on which merchandise is placed for display. While such gondolas are typically employed for the display of goods directly on the selling floor, similar structures are employed in freezer cases and the like for the display and storage of refrigerated goods.

Such gondolas are required to display and support an ever increasing variety of products in a staggering assortment of packaging. Each product must be displayed in a gondola at an assigned location, not intermixed with other products or even with the same product in a different size or packaging. The current gondola merchandising system is typically ill-equipped to handle such variety. There is typically not enough gondola space available to keep and display all the products neatly and efficiently.

Conventional gondola shelving is particularly ill-equipped to display and maintain product in the manner which is adaptable to products of varying sizes and shapes. Further, standard shelving does not allow for a significant amount of inventory to be kept on the shelf, thus requiring store personnel to continuously monitor the shelves and restock the shelves as their inventory drops. Still further, the fixed nature of conventional shelves makes it difficult for restocking, the store personnel being required to reach back to the rear portions of the shelf which are typically difficult to access due to the presence of adjacent shelves. The fixed orientation of the shelves provide a sterile display environment and make it difficult for product to be seen and accessed by the consumer.

OBJECTS AND ADVANTAGES OF THE PRESENT INVENTION

It is accordingly an object of the present invention to provide an improved shelving system for supporting a variety of products in a store environment.

Another object of the present invention is to provide a shelving system which allows a greater inventory of product to be maintained over conventional shelf systems.

Another purpose of the present invention is to provide a shelf system which includes a mechanism by which product can be directed to the front of the shelves to enhance visibility and improve customer convenience.

Another object of the present invention is to provide a shelf system in which the shelves include a forward recess area to allow the product to be directed to the front of the shelf.

Yet another object of the present invention is to provide an independent shelving structure which maximizes the use of available space through a shelf construction which does not require external stiffeners which limit the useful size of the shelf.

Still another object of the present invention is to provide a shelf system which allows the size and orientation of individual shelves to be adjusted in a shelf array.

Another object of the present invention is to provide a shelf system which allows for increased efficiency in the balancing and adjustment of inventory through variation in shelf configuration and division to accommodate varying inventory requirements for products, while not sacrificing frontal shelf facing.

BRIEF DESCRIPTION OF THE INVENTION

In accordance with the foregoing and other objects, the present invention consists of a shelf unit which is mounted to a pair of opposed uprights which themselves are adaptable to be mounted to the uprights found in conventional gondola-type constructions. Each shelf unit contains a forward and rear portion, the rear portion being pivotally attached to the forward portion, permitting the rear portion to be pivoted upwardly and to be maintained in that position. Such an orientation allows for a gravity feed inventory to be maintained towards the rear of the shelf, the products so placed being urged forwardly along the slope of the shelf to present the products towards the front of the shelf. The rear portion of the shelf can further be oriented at a greater pitch, forming a rear shelf wall, to foreshorten the depth of the shelf unit when required.

Each shelf unit is further slidably mounted on its brackets. This allows the shelf to be moved to complement the positioning of neighboring shelves and to vary the relative positioning of a vertical array of shelves to present a "waterfall" pattern which improves product visibility. In addition, the rear shelf portion is of an extensible form, allowing the working area of the shelf to be enlarged when the shelf is in a forward position. The precise formed position of the shelf can be varied in small increments, typically one-half inch.

An integrated shelf system in accordance with the present invention further comprises a shelf unit which is adapted to rest on a gondola floor, rather than being mounted upon support brackets. Such a shelf may have the same operational and functional characteristics as a bracketed shelf and allows a shelf system to be formed in a refrigerated case, for example, in which the lower portion of the case is not provided with vertical shelf supports.

To further enhance the efficiency of the shelf system, a variety of dividers and brackets may be provided to interface with the individual shelf units in their various configurations. The use of such dividers, in conjunction with the flexibility provided by the shelf adjustability, allow the shelf space so created to be customized and divided in an individual manner as required or desired taking into account the products located thereon.

BRIEF DESCRIPTION OF THE DRAWINGS

A fuller understanding of the present invention will be achieved upon consideration of the following, detailed description of a preferred, but nonetheless illustrative embodiment thereof, when review in association with the annexed drawings, wherein.

Figure 1:
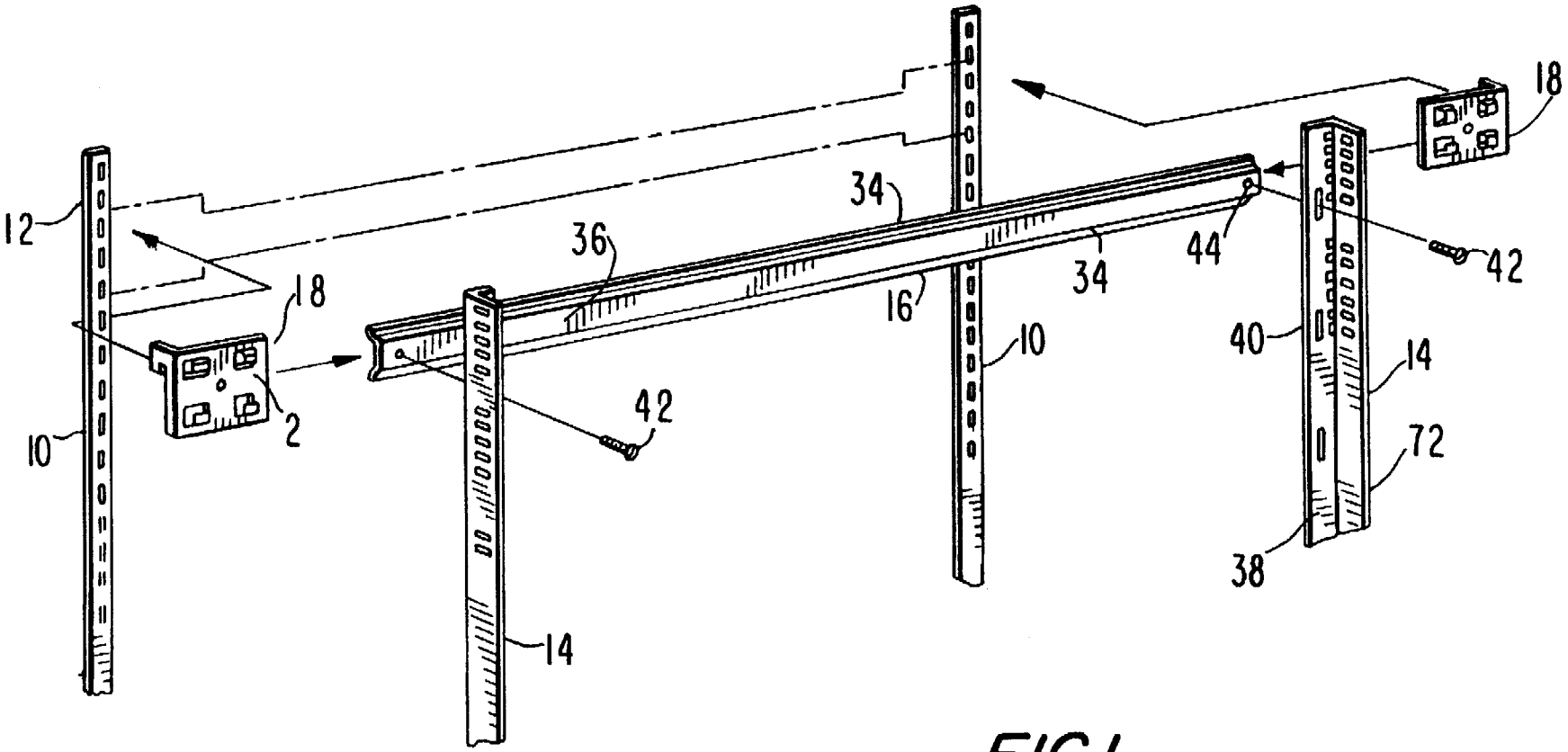
FIG. 1 is a perspective view of the mounting means for the present invention in a conventional gondola.
Figure 2:
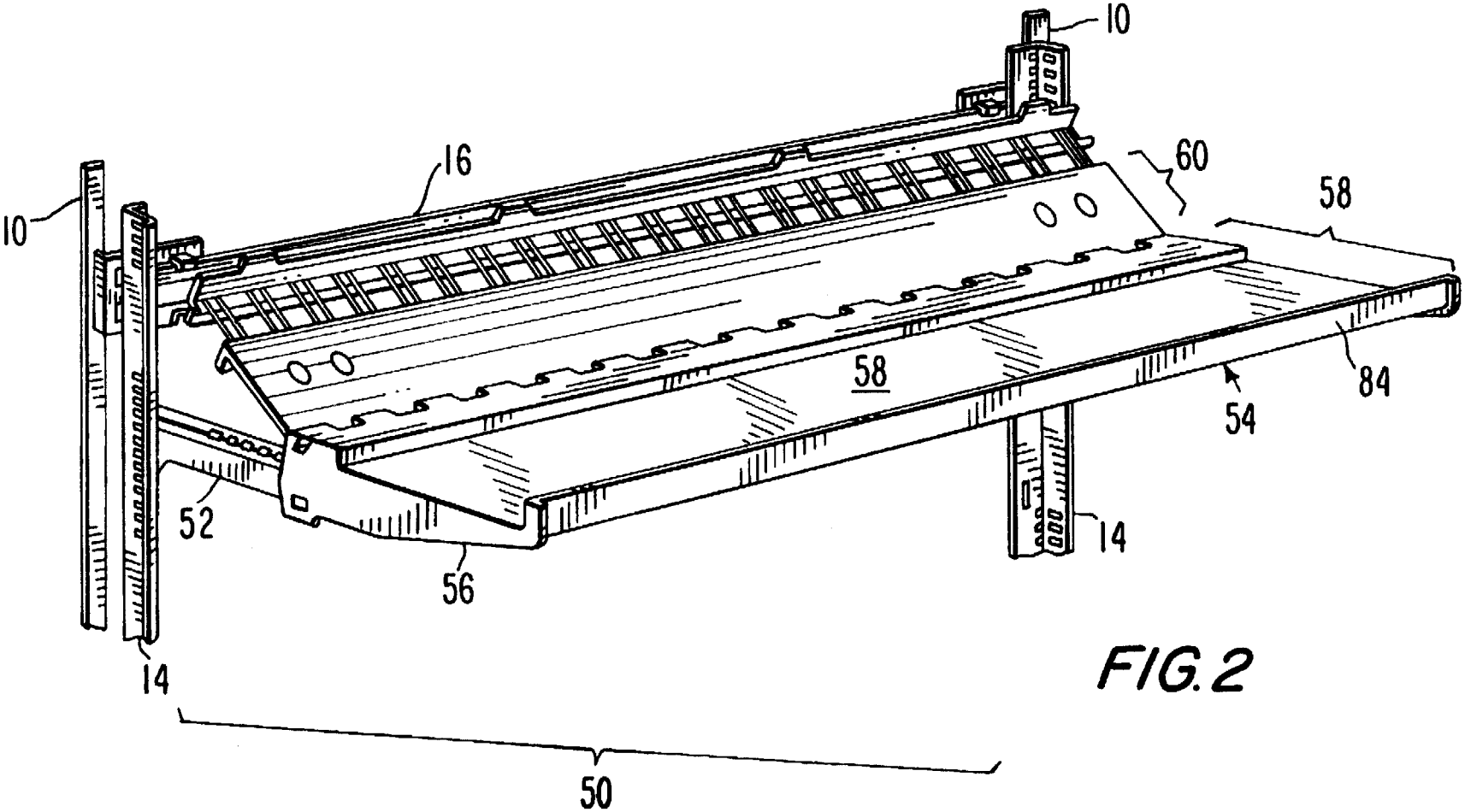
FIG. 2 is a perspective view of a shelf of the present invention mounted on the associated support structure.
Figure 3:
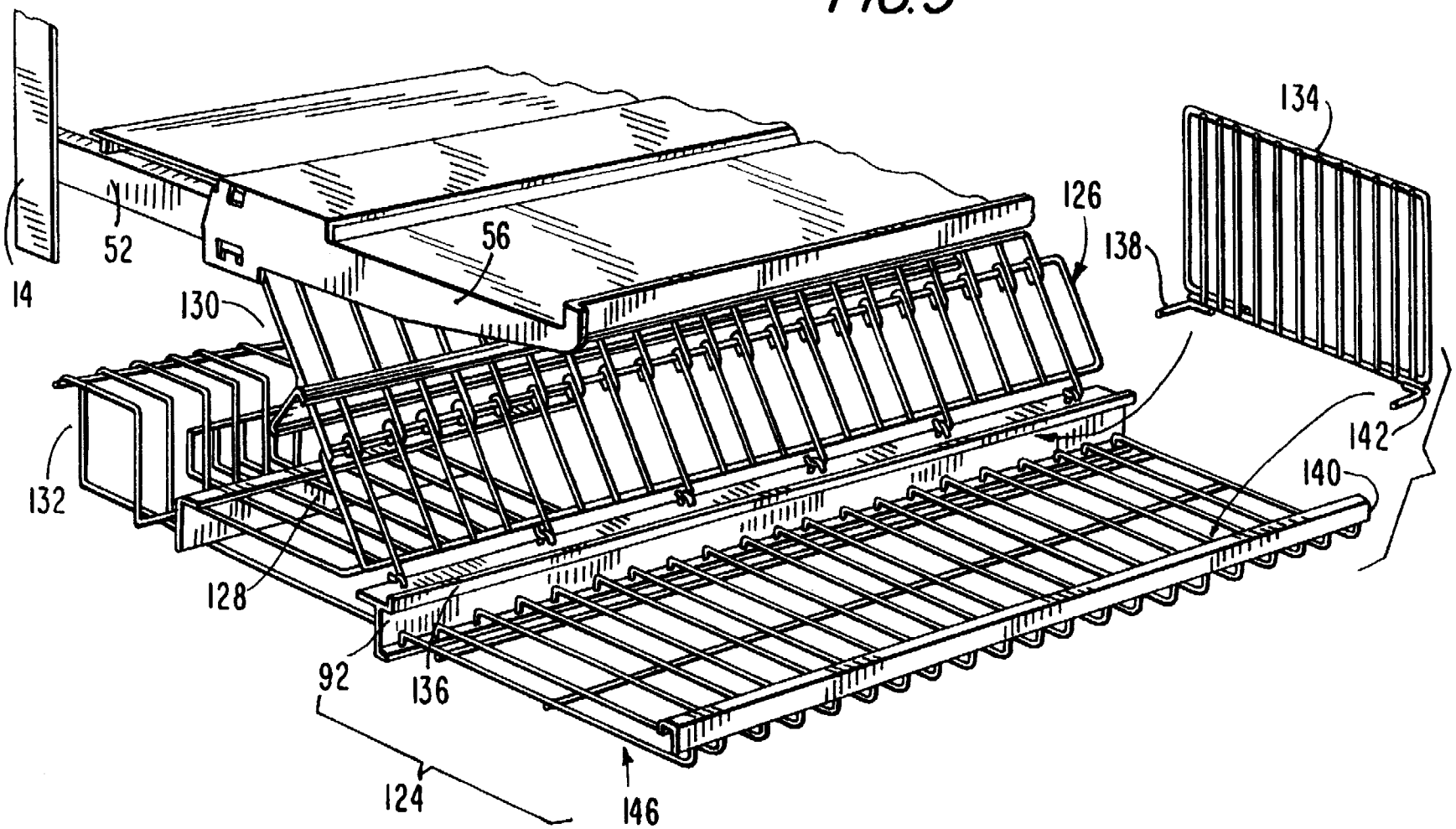
FIG. 3 is a perspective view of a surface mount shelf constructed in accordance with the present invention.

With initial reference to FIGS. 1, 2 and 3, the present invention provides an integrated, fully adjustable shelf system that may be utilized in connection with conventional store display gondola constructions. The shelves of the present invention provide both a shelf assembly supported by brackets (FIG. 2) as well as a bottom supported shelf assembly (FIG. 3) which may be integrated into a complete gondola-based product display and organizer system. The shelves are adapted to be mounted to conventional gondola-type constructions, having spaced vertical supports 10 bearing a plurality of slots 12, as known in the art. The shelf construction includes a pair of auxiliary uprights 14 mounted to a series of crossbars 16 which are themselves mounted to the gondola verticals 10 by end brackets 18. The shelves are mounted to and supported by the auxiliary uprights 14. Each of the shelves includes the unique construction embodied in the present invention which permits it to be extended, the length to be adjusted, and a portion of the shelf to be inclined in accordance with the objectives of the invention.

Figure 4B:
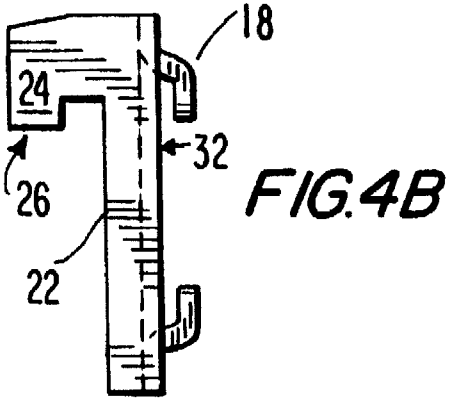
FIGS. 4A and 4B are front and side elevation views, respectively, of a bracket which engages the uprights of a conventional gondola assembly.
Figure 4A:
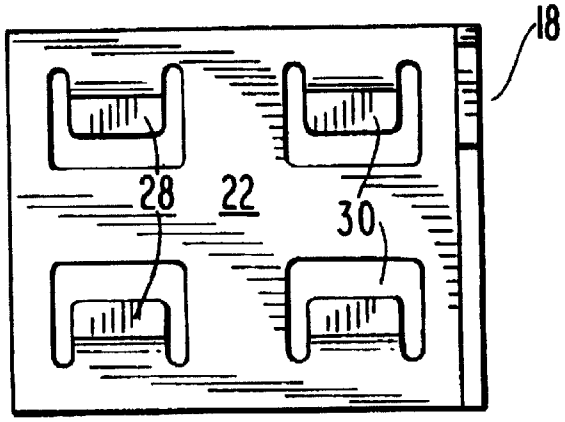

As seen in FIGS. 4A and 4B, the end brackets 18 are formed in a general L-shape as seen from above, with a main face portion 22 and a rearwardly-extending, right angle hook arm 24 with hook portion 26 adapted to be inserted into a slot 12 of a gondola vertical 10. The main face portion 22 includes right and left vertical pairs 28 and 30, respectively, of inwardly-facing clips which cooperate to define a front channel 32 into which the crossbar 16 may be inserted. As may be seen from FIG. 1, the crossbar 16 comprises a pair of parallel side rail portions 34 along the edges of main body portion 36. The side rails are engaged by the channels 32 in the end brackets.

Figure 5A:
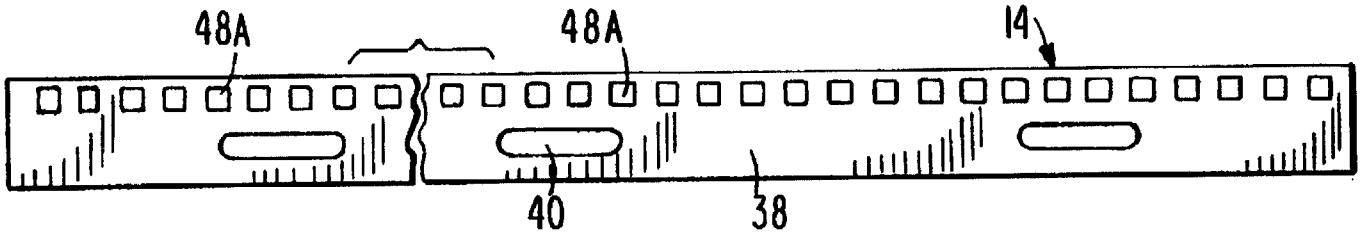
FIGS. 5A and 5B are front and side elevation views, respectively, of an upright used to support the shelf brackets of the invention.
Figure 5B:
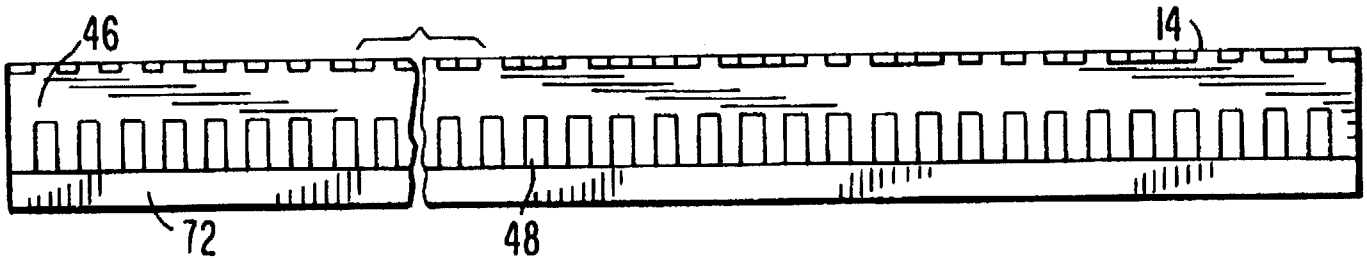

As best seen in FIGS. 1, 5A and 5B, the auxiliary uprights 14 are also of L-shape cross-section, a first arm portion 38 of the upright having a series of spaced, elongated vertical slots 40. The slots 40 allow the auxiliary upright to be mounted to crossbars 16 by use of a screw 42 through a slot 40 and into an accepting bore 44 in the end of the crossbar. The screw can also affix the crossbar in position to the end bracket 18. The existence of the slots 40 allow for vertical adjustment between the uprights and the crossbar to accommodate any minor spacing variations which would exist in the arrangement of the slots on the gondola verticals 10, and thus the relative vertical positionings of the end brackets 18 supporting the crossbars.

The second arm 46 of the upright 14, which forms a right angle to first arm 38, extends outwardly from the crossbar and is provided with a plurality of closely-spaced, horizontally-extending slots 48. The slots continue across the interface between the two arms, thus providing slot portions **48*a* on the first arm 38, as seen in FIG. 5A. The use of such horizontally oriented slots, which may have a vertical spacing on the order of one-half inch, provides for precise, incremental spacing of the shelves mounted to uprights. The vertical slots 12 on the conventional gondola uprights 10 do not allow such adjustment to be attained. The front edge of the second arm may be rolled over at 72** to provide a smooth exposed edge.

As shown in FIG. 2, each of the supported shelf assemblies 50 are supported by a pair of opposed main shelf brackets 52 able to be mounted to the uprights 14. The main shelf brackets which in turn each support an adjustable shelf unit 54. Each of the shelf units 54 is formed with a pair of opposed sliding side brackets 56 which support forward main shelf portion 58 and pivotable rear inventory gate portion 60, which may be oriented either horizontally to serve as additional shelf area or, pivoted upwardly, to serve as either a rear terminator for the shelf, shortening the shelf and allowing inventory for a directly lower shelf to be stacked upwardly behind the raised gate, of if inclined, as a gravity-feed mechanism for the shelf.

Figure 6A:
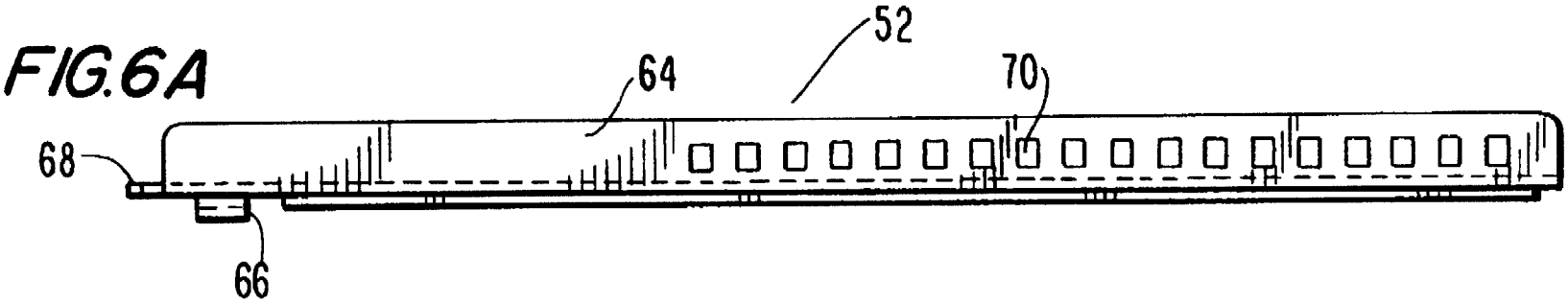
FIGS. 6A and 6B are top plan and side elevation views, respectively, of a support bracket for a shelf.
Figure 6B:
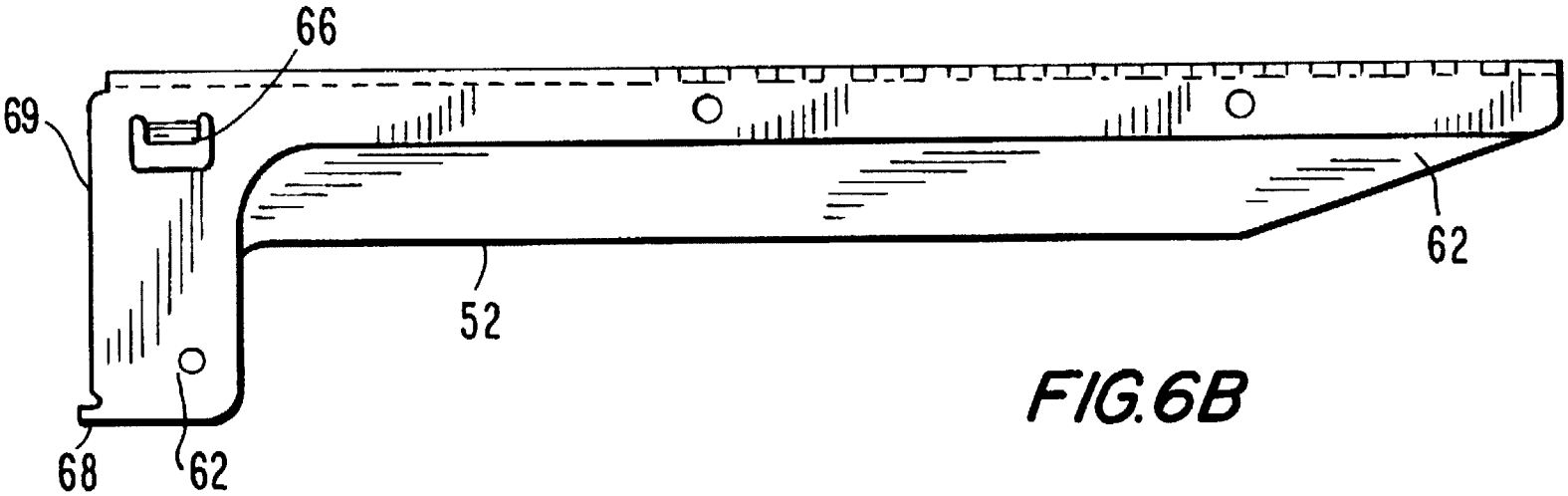

Referring to FIGS. 6A and 6B, each shelf bracket 52 includes L-shaped vertical sidewall portion 62 coupled to right angle, inwardly-directed top wall 64. The top and bottom edges of the sidewall are parallel along the main portion of its length. A downwardly-projecting right angle tab 66 is located at the rear of the sidewall, proximate the top wall, and is dimensioned to be insertable into and thus engage a chosen slot 48 in the auxiliary upright 14. A rearwardly-extending tab 68 is located at the bottom of the sidewall and is similarly dimensioned to engage one of the slot portions **48*a* in the first arm 38 of the upright. The combination of engagement means extending in two perpendicular planes, whereby upon engagement the rear vertical edge 69 of the shelf bracket rests against the first arm 38 of the upright, provides for simple bracket insertion and removal while providing for enhanced rigidity and strength when in the installed position, as the locking occurs in two planes. In addition, the close spacing of the slots 48 and 48*a* in the upright position allow precise vertical positioning to be accomplished. A further benefit of such a structure is that a shelf unit can be installed with a minimum of labor, by a single installer. Located along top wall 64 is a plurality of slots 70, which inter-engage with compatible mounting means on the shelf unit 54** to allow adjustability in front-to-back placement of the shelf unit upon the brackets.

Figure 7A:
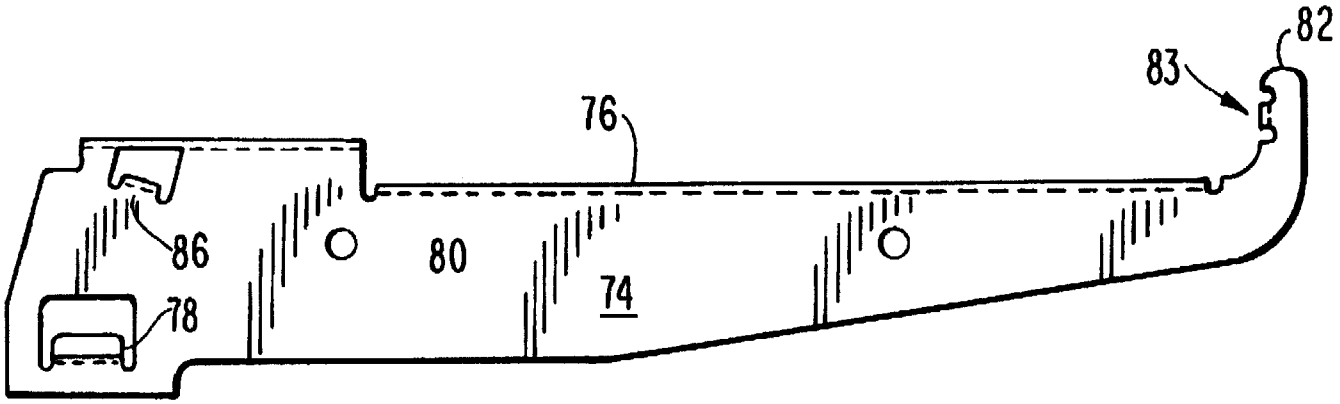
FIGS. 7A and 7B are side elevation and top plan views, respectively, of a sliding bracket for a shelf which cooperates with the bracket of FIGS. 6A and 6B.
Figure 7B:
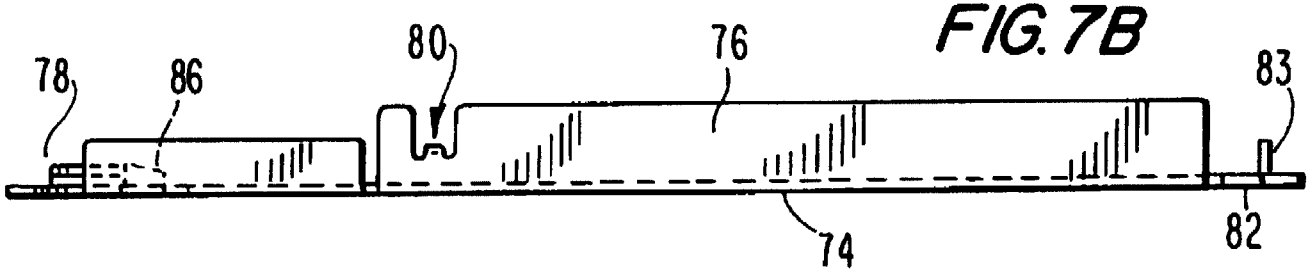

The shelf units 54 are supported-for sliding movement upon the shelf brackets 52 through the slide brackets 56, shown in FIGS. 7A and 7B. As depicted therein, each of the brackets 56 is of a similar construction to that of the main shelf brackets 52, and include a sidewall 74 and an inwardly-directed right angle top wall 76. The sidewall 74 is provided with an inwardly-directed tab 78 proximate its rear edge, the combination of the tab engaging the lower edge of bracket 52 and the inwardly-directed top wall 76 resting upon the upper edge of bracket 52 serving as guide means for the sliding bracket along the parallel edges with which it is engaged, as may be seen in FIG. 2. A locking tab 80 extends downwardly from the top wall 76, and is located to engage a chosen one of the slots 70 on the top wall of the fixed bracket 52 to allow the shelf unit to which the sliding brackets are mounted to be removably locked in a chosen location along the fixed brackets. Because the top wall 76 having the locking tab 80 is located forward of the first tab 78, it is to be appreciated that a shelf unit can be simply pivoted slightly upwardly from the horizontal about the first tab to disengage the locking tab 80 to permit the sliding brackets and shelf to be positioned as desired.

A third, angled tab 86 also is located proximate the rear upper edge of the bracket. The tab contacts the upper edge of the fixed bracket when the sliding bracket is pivoted upwardly for repositioning, and serves as a stop therefor.

The sliding bracket is provided with an upturned nose 82, which include, mounting means 83 for a horizontally-extending rail extrusion 84, as seen in FIG. 2, which extends across the width of the shelf and which may be utilized for the display of price, UPC and other information relating to the products arrayed on the shelf.

Figure 8:
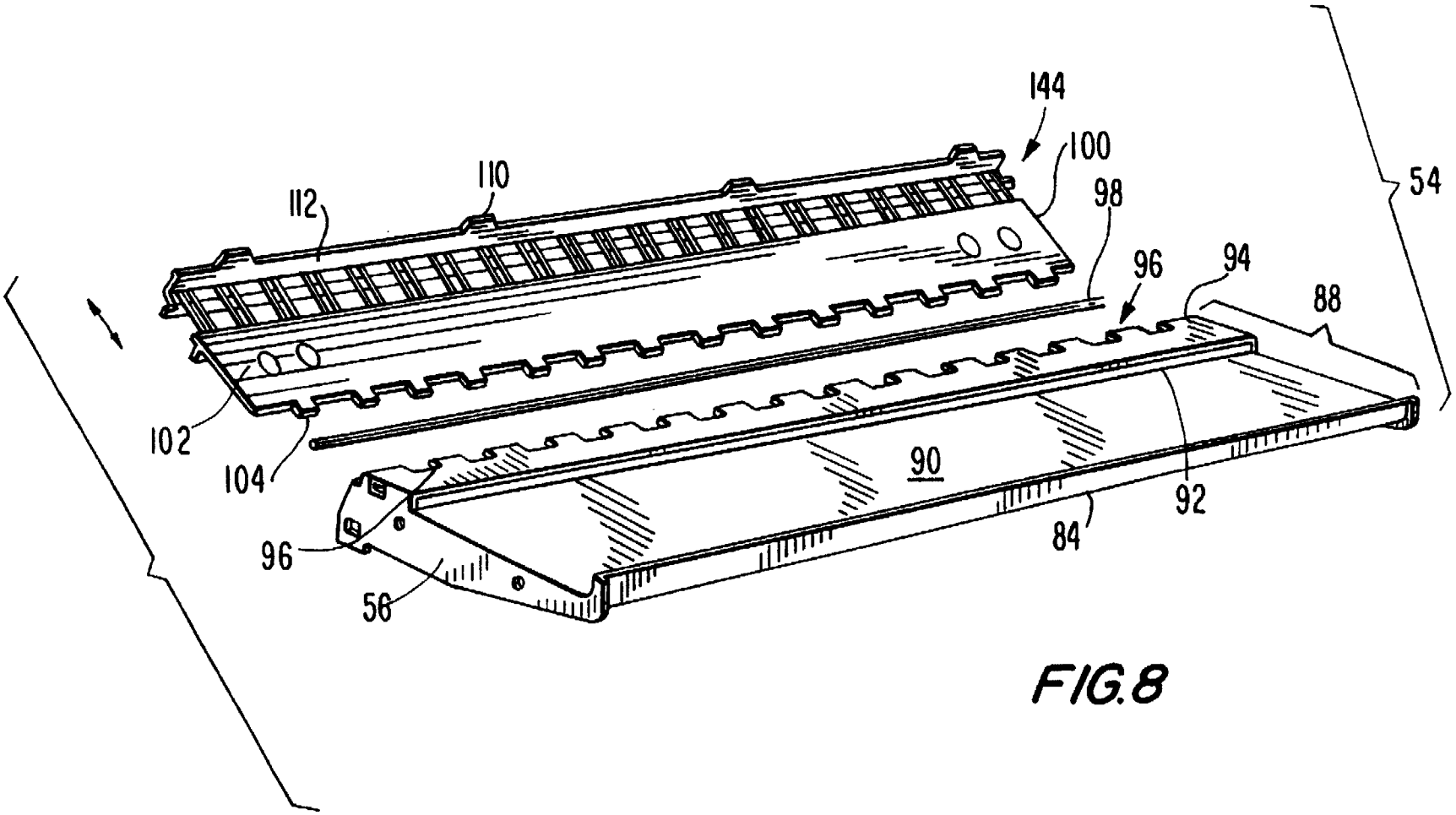
FIG. 8 is an exploded perspective view of a shelf unit, depicting the interconnections between the front and rear sections thereof.

FIG. 8 provides an exploded perspective view of the shelf unit 54 as further shown in FIG. 2. As presented therein, the shelf comprises a forward shelf portion 88 which may have a front edge defined by the extrusion 84 extending between the nose portions of the sliding brackets 56. The forward shelf portion 88 consists of a main shelf area 90 coupled by an intermediate transverse ledge 92 to a raised rear portion 94. The rear portion 94 may be provided with a series of rearwardly-extending rod-accepting loops or holders 96 adapted to accept a rod 98, which serves as a pivot post for the inventory gate assembly 100. The inventory gate assembly 100 may itself be formed of a forward portion 102, similarly provided with rod holder portions 104 which interdigitate with the rod holders 96 to form, with the rod, a hinge assembly between the forward shelf portion and inventory gate assembly. The inventory gate assembly 100 further includes a comb-like portion 144 which is adapted to slide forwardly and rearwardly, as depicted by the arrow in FIG. 8. The inventory gate assembly may be positioned horizontally to serve as the rear portion of the shelf, or may be pivoted to an inclined orientation.

Figure 9:
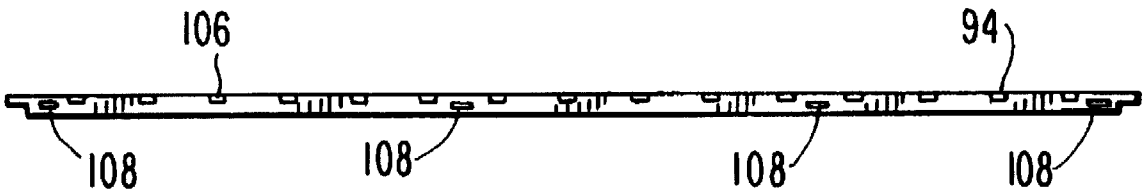
FIG. 9 is a rear elevation view of the rearward portion of a front shelf section.

FIG. 9 presents a rear view of the raised rear portion 94 of the forward shelf portion 88. In addition to slots 106 which define therebetween the rod-accepting holder portions 96, there are provided four rectangular slots 108. These slots are dimensioned to accept a series of matching hook-like fingers 110, as seen in FIGS. 2, 8, 10A and 10B, which extend from an upwardly-directed rear wall 112 at the rear of the comb-like portion of the inventory gate assembly. As will be further explained, by pivoting the inventory gate assembly of a first shelf upwardly into an upright position, the fingers can engage the slots 108 of a second, above-positioned shelf, narrowing the depth of the first shelf and providing a full length vertical wall, behind which inventory from a lower shelf may be stacked.

Figure 10A:
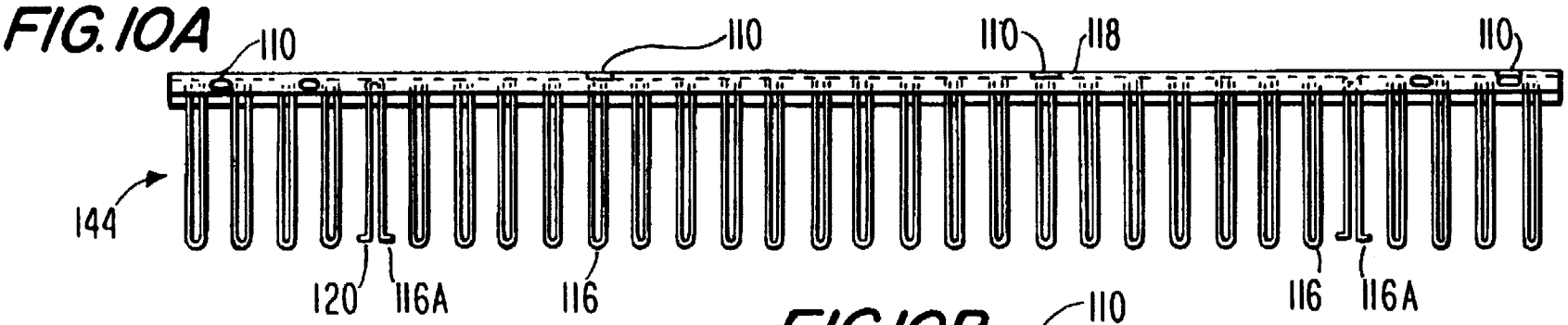
FIGS. 10A and 10B are top plan and side elevation views, respectively, of the rearward portion of a rear shelf section.
Figure 10B:
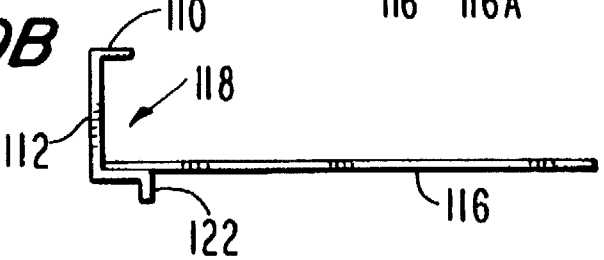
Figure 11A:
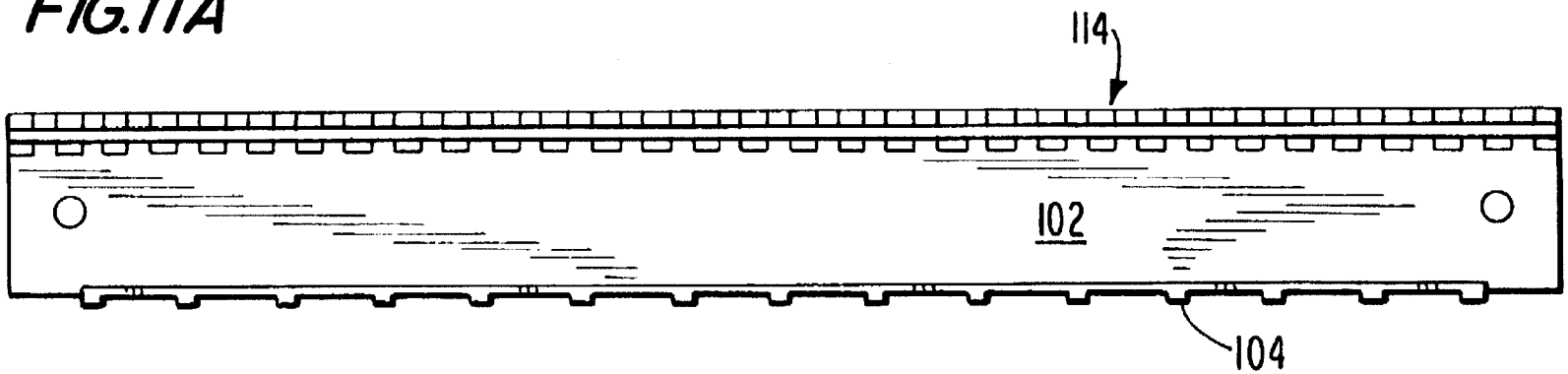
FIGS. 11A and 11B are top plan and rear elevation views, respectively, of the forward portion of a rear shelf section.
Figure 11B:
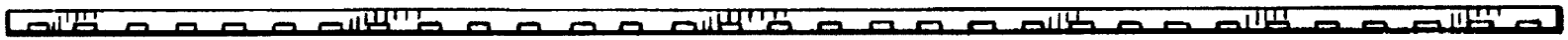

The construction of the inventory gate assembly 100 is further detailed in FIGS. 10, 11*a* and 11*b*. As shown therein, the forward or top shelf portion 102, in addition to having on its front edge the rod-holder portions 104, has at its rear edge a slot assembly 114, having a plurality of slots therein, each of which is adapted to accept a wire finger 116 formed as a part of the comb-like portion 144, depicted in FIGS. 10A and 10B. As seen in those figures, the comb-like portion consists of a plurality of such fingers, each formed from a U-shaped wire, joined at their rear ends to a transverse bar 118. A pair of fingers 116A, rather than being looped at their distal ends, are each provided with a pair of oppositely-directed stubs 120. These stubs prevent complete removal of the comb-like portion from the slots in the forward portion. As may be seen in FIG. 10B, the transverse bar 118 includes a downwardly-extending leg 122 which supports the comb-like portion in the horizontal planar with the forward portion, as well as the hook-like fingers 110 to engage slots 108.

In the elevated position, with the fingers 110 engaging the slots of the shelf above, the inventory gate can serve as a rear, gravity feed for products placed on the shelf unit. In such a position, the lower, front main portion 90 of the shelf effectively serves to retain the products after they have been directed downwardly and forwardly as a result of such gravity feed.

As depicted in FIG. 3, a shelf system utilizing the present invention may incorporate a lower shelf-like assembly 146 adapted to rest on the bottom surface of a gondola, rather than being supported by brackets. Such a structure may be constructed analogously to a shelf of the present invention, and thus may include a forward shelf portion 124 and an inventory gate portion 126 itself having front 128 and comb-like sections 130, the inventory gate being slidable with respect to the front section and being engageable with a shelf located above. Such a shelf assembly may have a further, rearwardly located ledge 132. FIG. 3 also illustrates that the entire shelf unit may be formed of an open wire construction without departing from the scope of the invention.

As further depicted in FIG. 3, the shelves of the present system may further be provided with a variety of divider elements, exemplified by the divider 134, which allows the shelf area to be subdivided into individual product-accepting areas. Such dividers may be of a full length, corresponding to the depth of the shelf when the rear portion is flat, or may be of a shortened length, corresponding to the depth of the front portion of the shelf, when the inventory gate portion is pivoted upwardly. As depicted in the Figure, the transverse ledge 92 may include a forwardly-directed slot 136 to accept a pin 138 on the divider, while a transverse rail 140 may be provided at the front edge of the forward shelf portion 124 to form a rearwardly-facing second slot or channel to accept a second pin 142.

The present invention represents a substantial improvement over conventional shelving systems. Because the fixed shelf brackets are mounted to uprights in two perpendicular planes, the shelves are supported with great rigidity. In addition, the forming of a trough in the main shelf portion with the ledge 92 provides for lateral rigidity of the shelf, avoiding the necessity for shelves of extensive thickness. Because each of the shelves is adjustable in both depth and area, a shelf display can be formed in a cascade "waterfall" pattern, with the lower shelves extending outward to a greater degree than the upper shelves. Such an arrangement facilitates the display and observation of the product by consumers. The provision for such a display, coupled with the ability to adjust the actual shelf area through positioning of the inventory gate, which provides for increased inventory volume for an adjacent lower shelf, provides extreme versatility in product arrangement, and efficiency in shelf planogramming and stocking.

I claim:

1. A shelving system for use in connection with a gondola-type store display having a pair of spaced, aperture-bearing uprights, said display system comprising:

first and second uprights, mountable to said gondola uprights;

first and second main shelf brackets respectively mountable upon said first and second uprights and extending outwardly therefrom; and a shelf assembly mountable upon said main shelf brackets, said shelf assembly having forward main shelf and rear gate shelf portions, said forward main shelf portion comprising first and second shelf areas joined by an intermediate longitudinal step, said first shelf area being located at a lower end of said step, said rear gate shelf portion being pivotable between a horizontal position and an elevated position.

2. The shelving system of claim 1, wherein said first and second uprights comprise a pair of walls forming a right angle therebetween, each of said walls having a series of apertures therein, said main shelf brackets comprising top and side walls, said top wall having a connector for engagement with a selected aperture on one of said pair of upright walls, said side wall having a connector for engagement with a corresponding selected aperture on the other of said pair of upright walls.

3. The shelving system of claim 2, wherein said series of apertures on said upright walls are spaced on one-half inch centers.

4. The shelving system of claim 2, wherein said shelf assembly further comprises a pair of parallel sliding side brackets located at opposite sides of said shelf assembly adapted and constructed to slide upon said main shelf brackets.

5. The shelving system of claim 4, wherein said main shelf brackets and said sliding side brackets include mating indexing means to maintain said sliding side brackets at a chosen position along said main shelf brackets.

6. The shelving system of claim 5, wherein said indexing means comprise a series of apertures located on said top walls of said main shelf brackets and downwardly-extending tabs located on top walls of said sliding side brackets.

7. The shelving system of claim 5 or claim 6, wherein said side walls of said main shelf brackets have parallel top and bottom edges, at least one of said sliding side brackets having a tab on a side wall to embrace said bottom edge.

8. The shelving system of claim 1, claim 2 or claim 4, wherein said rear gate shelf portion comprises first and second transversely-extending portions slidably connected together.

9. The shelving system of claim 8, wherein said second transversely-extending portion is located rearwardly of said first transversely-extending portion and is formed of a plurality of parallel fingers.

10. The shelving system of claim 9, wherein said first transversely-extending portion includes a rear edge having apertures therein to receive said parallel fingers.

11. The shelving system of claim 10, wherein said first transversely-extending portion of said rear gate shelf portion has a front edge pivotally mounted to a rear edge of said forward main shelf portion.

12. The shelving system of claim 11, wherein said second transversely-extending portion includes means for engagement with cooperating means located on a second shelf assembly mounted above said second transversely extending portion to retain said rear gate shelf portion in an elevated position.

13. The shelving system of claim 12, wherein said engagement means on said second transversely-extending portion comprise a plurality of hooks.

14. The shelving system of claim 13, wherein said rear edge of said first transversely-extending portion has a plurality of slots comprising said cooperating means for another shelf assembly.

15. The shelving system of claim 7, wherein a side wall of said sliding side bracket forms a sidewall for said shelf assembly.

16. The shelving system of claim 15, wherein said sidewall of said sliding bracket include a frontal portion adapted to support a shelf rail.

17. The shelving system of claim 4, further comprising a second shelf assembly adapted to rest on a bottom surface of the gondola display, said second shelf assembly comprising a shelf having forward main shelf and rear gate shelf portions, said rear gate shelf portion being pivotable between a horizontal position and an elevated position.

18. The shelving system of claim 17, wherein said rear gate shelf portion of said second shelf assembly comprises first and second transversely-extending portions slidably connected together.

19. The shelving system of claim 17, wherein said first transversely-extending portion of said rear gate shelf of second shelf assembly is pivotally connected to a rear ledge of said forward shelf portion.

20. The shelving system of claim 18, wherein said forward shelf portion includes a pair of transverse slot-forming members dimensioned to accept mounting means for at least one shelf divider.

* * * * *